US008077046B1

(12) United States Patent
Wong

(10) Patent No.: US 8,077,046 B1
(45) Date of Patent: Dec. 13, 2011

(54) FALSE ALARM RESISTANT AND FAST RESPONDING FIRE DETECTOR

(75) Inventor: Jacob Wong, Goleta, CA (US)

(73) Assignee: Airware, Inc., Goleta, CA (US)

( * ) Notice: Subject to any disclaimer, the term of this patent is extended or adjusted under 35 U.S.C. 154(b) by 0 days.

(21) Appl. No.: 12/901,355

(22) Filed: Oct. 8, 2010

(51) Int. Cl.
*G08B 17/12* (2006.01)

(52) U.S. Cl. ..... 340/577; 340/501; 340/517; 340/521; 340/522; 340/523; 340/526; 340/578; 340/579; 340/628; 340/630

(58) Field of Classification Search ..... 340/539.26–539.27, 577–584, 340/589, 628–634, 501, 517, 521–522, 526
See application file for complete search history.

(56) References Cited

U.S. PATENT DOCUMENTS 5,691,704 A * 11/1997 Wong ..... 340/628
5,767,776 A * 6/1998 Wong ..... 340/632
5,774,038 A * 6/1998 Welch et al. ..... 340/286.05
5,912,624 A * 6/1999 Howard, II ..... 340/632
5,945,924 A * 8/1999 Marman et al. ..... 340/928
5,966,077 A * 10/1999 Wong ..... 340/630
6,107,925 A * 8/2000 Wong ..... 340/628
6,110,038 A * 8/2000 Stern ..... 454/343
6,166,647 A * 12/2000 Wong ..... 340/628
7,142,105 B2 * 11/2006 Chen ..... 340/521
7,170,418 B2 * 1/2007 Rose-Pehrsson et al. .... 340/628

* cited by examiner

*Primary Examiner* — Daniel Wu
*Assistant Examiner* — Son M Tang
(74) *Attorney, Agent, or Firm* — Wagner, Anderson & Bright, P.C.; Roy L Anderson

(57) ABSTRACT

A fire detector and method of using it generate a fire alarm through use of a smoke detector and a carbon monoxide detector once the smoke detector detects a threshold level of light obscuration for greater than a first pre-selected time period or a reduced threshold level of light obscuration for greater than a second pre-selected time period or the CO detector detects a rate of increase in CO concentration which exceeds a first preselected CO rate for a third pre-selected time period and the smoke detector detects the reduced threshold level of light obscuration or the rate of increase in CO concentration exceeds a second preselected CO rate for a fourth pre-selected time period. The fire detector and method can also use a carbon dioxide detector and generate the fire alarm when either a rate is of increase in concentration of $CO_2$ exceeds a first $CO_2$ predetermined rate for a fifth pre-selected time period and the smoke detector detects a reduced threshold level of light obscuration or the rate of increase in concentration of $CO_2$ exceeds a second $CO_2$ predetermined rate for a sixth pre-selected time period.

10 Claims, 2 Drawing Sheets

FALSE ALARM RESISTANT AND FAST RESPONDING FIRE DETECTOR

FIELD OF THE INVENTION

The present invention is in the field of gas analysis and more particularly relates to the use of gas sensors designed to accompany a conventional smoke detector in order to arrive at a false alarm resistant and fast responding fire detector.

BACKGROUND OF THE INVENTION

For more than two decades now, the use of a $00_2$ sensor as a standalone fire detector or in combination with smoke detectors has been continually advocated by experts as the most effective fire detector. The reason is two-fold. First, there is a significant advantage of using a $00_2$ sensor rather than a smoke detector for fire initiation detection. The mobility of $00_2$ as a gas is far greater than that for smoke which is much heavier. Therefore $CO_2$ diffuses from the fire to the detector in a much shorter time leading to a detector with a faster response time for enunciating a fire. Second, over the past two decades, compact, low cost and reliable NDIR type CO2 sensors have become readily available. As a matter of fact, over the same period of time, a large number of deployment schemes, fire fighting techniques and fire control strategies, which use either a standalone NDIR $00_2$ sensor or in combination with smoke detectors, have been advanced. The most notable proposals of such are summarized as follows.

In U.S. Pat. No. 5,053,754 (1991), Wong advanced the first NDIR $00_2$ sensor used as a standalone fire detector. A fire detection system using at least two NDIR $00_2$ sensors positioned at spaced locations in an area for pin-pointing the exact origin of a fire was described in U.S. Pat. No. 5,079,422 (1992) by Wong. Meanwhile a standalone and compact low cost fire detector which responds quickly to an increase in the concentration of $00_2$ gas in the ambient air was advanced in U.S. Pat. No. 5,103,096 (1992) by Wong. In U.S. Pat. No. 5,369,397 (1994), an adaptive fire detector taking advantage of the capability of an NDIR $CO_2$ sensor for computing the rate of 002 increase to shorten the response time for enunciating the onset of a fire was also advanced by Wong. In U.S. Pat. No. 5,592,147 (1997), an NDIR $00_2$ sensor used cooperatively in combination with a photoelectric smoke detector for significantly reducing false alarms was put forth by Wong. Also in 1997 and in U.S. Pat. No. 5,691,704, Wong disclosed another NDIR $CO_2$ photoelectric smoke detector combination fire detector with special software which can be designed into a single semiconductor chip for cost reduction and further false alarm reduction improvement. In U.S. Pat. No. 5,767,776 (1998), Wong disclosed the design of an NDIR $00_2$ and smoke detector combination fire detector which reduces the maximum average fire enunciation time to less than 1.5 minutes. Further refinement of this design was described in U.S. Pat. No. 5,798,700 (1998) by Wong, U.S. Pat. No. 5,945,924 (1999) by Marman et al. and U.S. Pat. No. 5,966,077 (1999) by Wong. Finally, a method for dynamically adjusting the criteria for detecting fire through smoke concentration using an NDIR $00_2$ and smoke detector combination was described by Wong in U.S. Pat. No. 6,107,925 (2000).

From the methodology listing and discussion elucidated above involving an NDIR $00_2$ sensor used either as a standalone fire detector or in combination with a smoke detector, the advantages in fire detection, both in the resistance against frequent false alarms and the provision of faster response to flaming or fast-moving fires, are quite obvious and cannot be easily denied. Yet today such a fire detection scheme has yet to be taken advantage of. There are several reasons for this. Even with the drastic cost reduction for present day NDIR $CO_2$ sensors, the cost is still too high when compared with ionization type smoke detectors. In addition, when an NDIR gas sensor operates continuously it tends to consume quite a bit more power than conventional smoke detectors, thereby posing an operational burden.

The most common smoke detectors currently in use today belong to two types. The first type is the so-called ionization smoke detector best for detecting almost invisible smoke particles ranging in size from <1.0 microns to ~5 microns. The second type is called the photoelectric smoke detector best for detecting visible smoke particles >5 microns in size. In recent years, photoelectric smoke detectors, because of their higher cost (~$30 retail), have fallen significantly behind ionization smoke detectors in sales. Combined ionization and photoelectric smoke detectors, albeit at an even higher cost (~$40 retail), have also been available for quite some time but have not to date received much acceptance by the general public.

Despite their low cost, relatively maintenance-free operation and wide acceptance by the general public, the smoke detectors in widespread use today are not without problems and certainly far from being ideal. One of the biggest problems with smoke detectors is their frequent false-alarm. By the nature of their operational principle, any micron-size particulate matter other than smoke from an actual fire can potentially set off the alarm. Kitchen grease particles generated by a hot stove is one classic example. Over-zealous dusting of objects and/or furniture near the detector is another. Frequent false-alarms are not just harmless nuisances, they can potentially tie up limited fire-fighting resources in many locales to fight real fires. Some people actually disable their smoke detectors by temporarily removing the battery in order to escape such annoying episodes. This latter situation could be outright dangerous especially when these people forget to rearm their smoke detectors afterwards by putting back the battery.

The present invention seeks to change the nature of smoke detectors used today. It proposes a smoke detector that does not suffer the drawbacks of an ionization smoke detector or a photoelectric smoke detector and yet it also does not suffer the drawbacks associated with prior attempts to either use an NDIR $00_2$ sensor as a standalone fire detector or in combination with smoke detectors.

SUMMARY OF THE INVENTION

The present invention is generally directed to a fire detector and method of using it in which a fire alarm is generated through use of a smoke detector and a carbon monoxide detector. A fire alarm is generated when the smoke detector detects a threshold level of light obscuration for greater than a first pre-selected time period or a reduced threshold level of light obscuration for greater than a second pre-selected time period. A fire alarm is also generated whenthe CO detector detects a rate of increase in CO concentration which exceeds a first preselected CO rate for a third pre-selected time period. A fire alarm is also generated when the smoke detector detects the reduced threshold of light obscuration and the rate of increase in CO concentration exceeds a second preselected CO rate for a fourth pre-selected time period.

In a first, separate group of aspects of the present invention, the fire detector and method also use a carbon dioxide detector and the fire alarm will also be generated when either a rate of increase in concentration of $CO_2$ exceeds a first $CO_2$ predetermined rate for a fifth pre-selected time period and the smoke detector detects a reduced threshold level of light obscuration or the rate of increase in concentration of $CO_2$ exceeds a second $CO_2$ predetermined rate for a sixth pre-selected time period.

In a second, separate group of aspects of the present invention, the smoke detector is either an ionization smoke detector or a photoelectric smoke detector and the CO and $CO_2$ detectors are Non-Dispersive Infrared detectors.

In a third, separate group of aspects of the present invention, the threshold level for the smoke detector is approximately 3.0% obscuration per 0.3048 meter (one foot), the first pre-selected time period is approximately 2.0 minutes, the reduced threshold level for the smoke detector is approximately 1.0% obscuration per 0.3048 meter (one foot), the second pre-selected time period is approximately 5-15 minutes, the first preselected CO rate is approximately 3 ppm/min, the third pre-selected time period is approximately 30 minutes, the second preselected CO rate is approximately 10 ppm/min, the fourth pre-selected time period is approximately 10 minutes, the first $CO_2$ predetermined rate is approximately 150 ppm/min, the fifth pre-selected time period is approximately 30 seconds, the second $00_2$ predetermined rate is approximately 700-1,000 ppm/min and the sixth pre-selected time period is approximately 30 seconds.

Accordingly, it is a primary object of the present invention to provide a false alarm resistant and fast responding tire detector and method of using it by incorporation of carbon monoxide sensor and a carbon dioxide sensor into a smoke detector only fire detector.

This and further objects and advantages of the present invention will be apparent to one of ordinary skill in the art in view of the drawings and the detailed description of the invention set forth below.

DETAILED DESCRIPTION OF THE INVENTION

Figure 1:
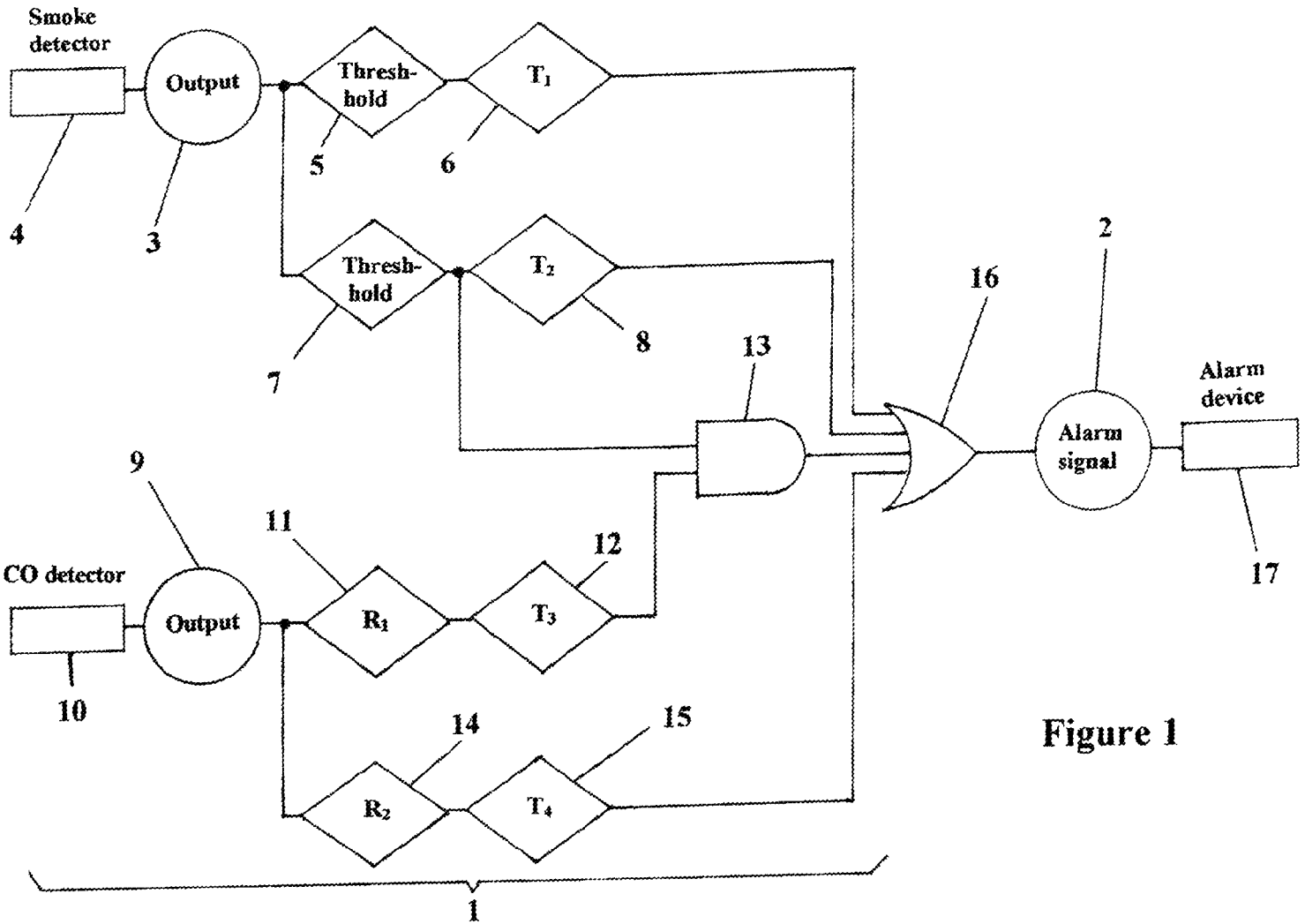
FIG. 1 is a logic diagram for a first preferred embodiment of a practical and false-alarm resistant fire detection system.

The present invention is generally directed to an improved fire detector that has a quick response time and yet is resistant to false alarms, while still being economically viable. Before disclosing the details of the present invention, it is worth understanding more about fire detectors and what has not, or will not work.

Because fire is an oxidation process, detection of a sudden increase in ambient levels of one or more effluent gases accompanying a fire, namely $00_2$, $H_2O$ and Carbon Monoxide (CO), might be a very effective way of detecting fire initiation.

Of the three principal effluent gases accompanying the onset of a fire, $H_2O$ is the least suitable for exploitation. The reason is that the concentration or the amount of $H_2O$ in the atmosphere is an extremely variant entity and it can change at any time without forewarning. Thus, when a gas sensor detects an increase in its concentration, there is no certainty at all to decide whether or not such an increase is caused by the onset of a fire.

While there have been attempts to use an NDIR $00_2$ sensor in a fire detector, as noted in the Background of this invention, it turns out that use of such a sensor faces certain limitations. One such limitation is the result of the fact that there are many $00_2$ sources that one can attribute to a sudden increase in its concentration in a particular location. However, the detection of a sudden increase in CO2 concentration near the fire detector is very useful, especially when a sudden increase in smoke is simultaneously detected or its rate of increase is abnormally high. In such cases, it surely indicates the onset of a flaming or fast-moving fire. Smoke detectors alone in this case would have severe limitation in the detection of such fires as they produce very little smoke, and this is the reason why such a combined fire detector is superior in performance to either an ionization or photoelectric smoke detector. But, even with such improved performance, such a combined detector will not result in too much of a difference in performance if the fire is a smoldering fire, which often takes place in residential homes, because only a relatively small amount of $CO_2$ is produced in such fires.

This is where the present invention comes into play because it recognizes that detection of carbon monoxide gas, which is present in smoldering fires, results in a superior fire detector when one takes into account its production in smoldering fires. In this regard, it turns out that the detection of the presence of CO alongside with smoke is by far the most useful since a smoldering fire will generate both species in relative abundance whereas a flaming fire will not. Furthermore, there is no good reason other than a fire or an incomplete combustion of sorts taking place in a locale when a sudden increase in CO concentration is detected within it. In either case it is a dire situation that one has to be aware of and deal with it as soon as possible. The object of the current invention is, therefore, to introduce a novel fire detection methodology comprising NDIR gas sensors for the detection of both $CO_2$ and CO gases in addition to an ionization or photoelectric smoke detector, taking full advantage of the fact that future NDIR gas sensors will get better and better over time. A fire detector armed with such a detection scheme will not only have faster response time to all manners of fires, from smoldering to flaming or fast-moving ones, but it will also be almost completely false-alarm resistant.

FIG. 1 is a logic diagram of a first embodiment of a practical and false-alarm resistant fire detection system 1 according to the present invention. As illustrated in FIG. 1, fire detection system 1 generates an alarm signal 2 when any of the following four conditions is met.

First, an alarm signal 2 will be generated if an output 3 of a smoke detector 4 exceeds a threshold level 5 of N % light obscuration per 0.3048 meter (1 foot) for greater than $T_1$, a first pre-selected time period 6. Smoke concentration measured in units of "percent light obscuration per 0.3048 meter (1 foot)" applies to both ionization and photoelectric smoke detectors although the output is different for them in reflecting such a smoke obscuration level. Second, an alarm signal 2 will be generated if output 3 from smoke detector 4 exceeds a reduced threshold level 7, of M % light obscuration per 0.3048 meter (1 foot) for greater than $T_2$, a second pre-selected time period 8.

Third, an alarm signal 2 will be generated if the rate of increase in the measured concentration of CO at an output 9 of a CO detector 10 exceeds $R_1$, a first predetermined rate 11 of X ppm/min for $T_3$, a predetermined time period 12 and a light obscuration level of output 3 of smoke detector 4 exceeds the reduced threshold 7. The output of the AND gate 13 indicates the satisfaction of this condition.

Fourth, an alarm signal 2 will be generated if the rate of increase in the measured concentration of CO exceeds $R_2$, a second pre-determined rate 14 of Y ppm/min for $T_4$, a predetermined time period 15. These four conditions are combined by an OR gate 16, the output of which produces an alarm signal 2 that in turns activates an alarm device 17.

The smoke detector 4 specified in fire detector 1 (see FIG. 1) above can either be an ionization smoke detector or a photoelectric smoke detector as long as their trigger level threshold for signaling a fire is set according to smoke concentration level measured in units of "percent light obscuration per 0.3048 m (1 foot)". The Carbon Monoxide (CO) detector 10 is preferably an NDIR type gas sensor.

The embodiment of a practical and false-alarm resistant fire detection system as described in FIG. 1 works very well for smoldering fires. However, its speed of response to flaming or rapidly moving fires might be too slow. Those types of fires involve mostly complete combustion, giving rise to an abundance of $CO_2$ gas but very little smoke or CO for detection. In order to overcome this speed of response limitation, the logic diagram of a second embodiment of the current invention is advanced and is depicted in FIG. 2.

Figure 2:
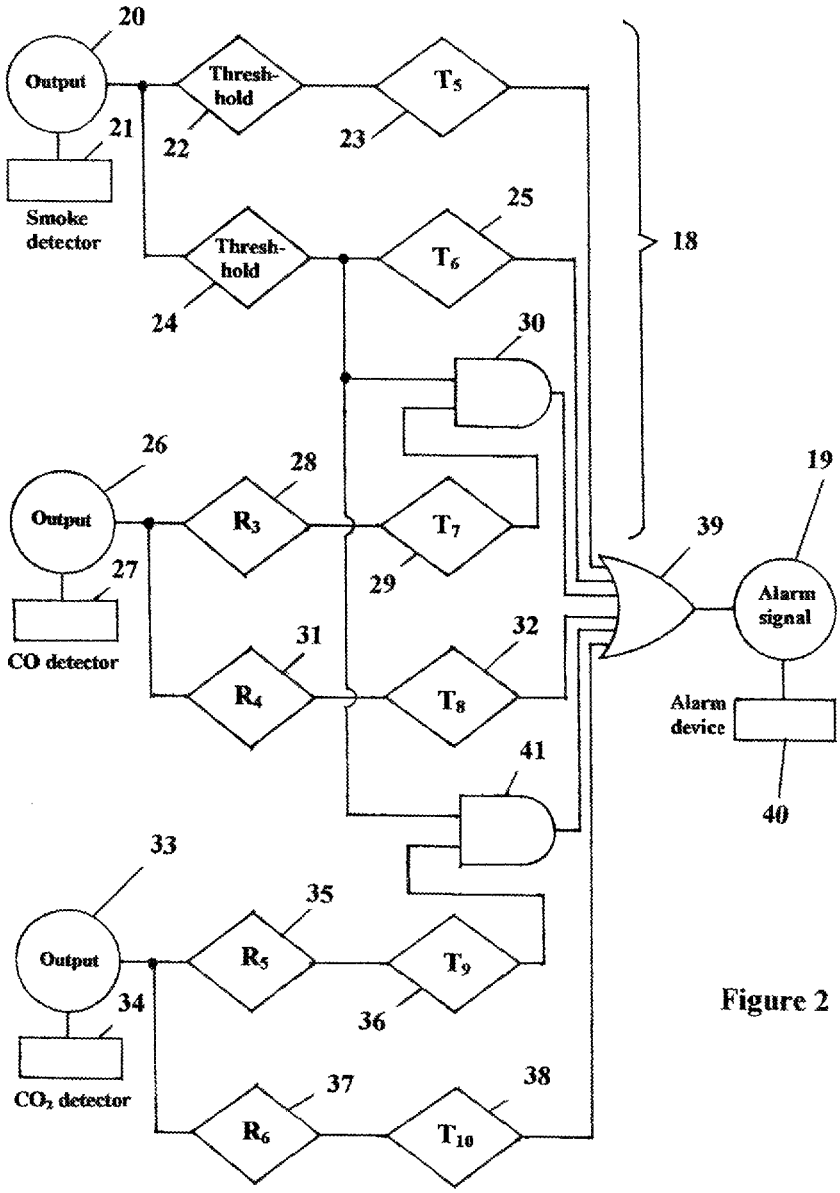
FIG. 2 is a logic diagram for a second preferred embodiment of a fast responding and false-alarm resistant fire detector system.

FIG. 2 is a logic diagram of a fast responding and false-alarm resistant fire detection system 18. As illustrated in FIG. 2, fire system 18 generates an alarm signal 19 when any of the following six conditions is met.

First, an alarm signal 19 will be generated if an output 20 of a smoke detector 21 exceeds a threshold level 22 of N % light obscuration per 0.3048 meter (1 foot) for greater than $T_5$, a first pre-selected time period 23. Smoke concentration measured in units of "percent light obscuration per 0.3048 meter (1 foot)" applies to both ionization and photoelectric smoke detectors although the output is different for them in reflecting such a smoke obscuration.

Second, an alarm signal 19 will be generated if output 20 from smoke detector 21 exceeds a reduced threshold level 24 of M % light obscuration per 0.3048 meter (1 foot) for greater than $T_6$, a second pre-selected time period 25.

Third, an alarm signal 19 will be generated if the rate of increase in the measured concentration of CO at an output 26 of a CO detector 27 exceeds a first predetermined rate $R_3$, 28, of X ppm/min for a predetermined time period $T_7$, 29 and light obscuration exceeds the reduced threshold 24. The output of the AND gate 30 indicates the satisfaction of this condition.

Fourth, an alarm signal 19 will be generated if the rate of increase in the measured concentration of CO at an output 26 of a CO detector 27 exceeds a second pre-determined rate $R_4$, 31 of Y ppm/min for a predetermined time period $T_8$, 32.

Fifth, an alarm signal 19 will be generated if the rate of increase in the measured concentration of $CO_2$ at an output 33 of a CO2 detector 34 exceeds a first predetermined rate $R_5$, 35, of Z ppm/min for a predetermined time period $T_9$, 36 and light obscuration level exceeds the reduced threshold 24. The output of the AND gate 41 indicates the satisfaction of this condition.

Sixth, an alarm signal 19 will be generated if the rate of increase in the measured concentration of $CO_2$ exceeds a predetermined rate $R_6$, 37, of ZZppm/min for a predetermined time period $T_{10}$, 38.

These six conditions are combined by an OR gate 39, the output of which produces an alarm signal 19 that in turns activates an alarm device 40.

The additional NDIR $CO_2$ detector deployed in the second preferred embodiment of the current invention as depicted in FIG. 2 is preferably also an NDIR type gas sensor. The first and the second preferred embodiments of the present invention shown respectively in FIGS. 1 and 2 rely upon additional gas sensors to assist the smoke detector to detect effluent gases from the fire, namely CO and $00_2$, in order to greatly improve its fire detection capability.

One of the greatest advantages of the currently invented fire detector system over the conventional smoke detector is almost a complete elimination of false alarms. Even though the obscuration threshold of a conventional smoke detector is exceeded by non-fire episodes, the currently invented fire system will not sound an alarm unless additionally either a threshold rate of increase of CO gas (see 11, 12 and AND gate 13 of FIGS. 1 and 28, 29 and AND gate 30 of FIG. 2) or a threshold rate of increase of $00_2$ gas (see AND gate 41 of FIG. 2) is also detected. Furthermore, the currently invented fire detector system will sound an alarm if the obscuration threshold of the smoke detector is exceeded for a predetermined period of time (see 5, 6 and the OR gate 16 of FIGS. 1 and 22, 23 and the OR gate 39 of FIG. 2). The currently invented fire detection system will also sound an alarm if the threshold rate of increase of CO gas is detected for a predetermined period of time (see 14, 15 and the OR gate 16 of FIGS. 1 and 31, 32 and the OR gate 39 of FIG. 2) or the threshold rate of increase of $00_2$ gas is detected for a predetermined period of time (see 37, 38 and OR gate 39 of FIG. 2).

Other advantages of the currently invented fire detection system in addition to an almost complete elimination of any false alarm without sacrificing the fire detection fidelity of the conventional smoke detector include (1) protection of occupants from deadly CO gas while a smoldering fire is in progress (see 14, 15 and OR gate 16 of FIGS. 1 and 31, 32 and OR gate 39 of FIG. 2) and (2) a much faster response to both smoldering and flaming or fast-moving fires. Because of the fact that the currently invented fire detector system relies upon additional gas sensors to detect effluent gases from a fire in addition to the smoke detector, it is possible to considerably lower the smoke concentration thresholds without incurring more false alarms. The lowering of smoke concentration thresholds for conventional smoke detector system under ordinary circumstances would be totally unacceptable due to the occurrence of even more false alarm episodes. As to flaming or fast-moving fires, conventional smoke detectors are notoriously known to be slow responding. On the other hand, the currently invented fire detector system is especially adept to detecting flaming or fast-moving fires by sounding an early alarm when a rate of rise threshold for $00_2$ gas is detected for a predetermined period of time (see 37, 38 and OR gate 39 of FIG. 2) accompanying the simultaneous detection of smoke obscuration.

While the invention has been described herein with reference to a couple of preferred embodiments, these embodiments have been presented by way of example only, and not to limit the scope of the invention. Additional embodiments thereof will be obvious to those skilled in the art having the benefit of this detailed description. Further modifications are also possible in alternate embodiments without departing from the inventive concept. Accordingly, it will be apparent to those skilled in the art that still further changes and modifications in the actual concepts described herein can readily be made without departing from the spirit and scope of the disclosed inventions.

What is claimed is:

1. A fire detector, comprising:

a smoke detector;

a carbon monoxide ("CO") detector; and a logic component for generating a fire alarm when any of the following criteria are met:

(1) the smoke detector detects a threshold level of light obscuration for greater than a first pre-selected time period;

(2) the smoke detector detects a reduced threshold level of light obscuration for greater than a second pre-selected time period;

(3) a rate of increase in CO concentration detected by the CO detector exceeds a first preselected CO rate for a third pre-selected time period and the smoke detector detects the reduced threshold level of light obscuration; or (4) the rate of increase in CO concentration detected by the CO detector exceeds a second preselected CO rate for a fourth pre-selected time period.

2. The fire detector of claim 1 wherein the threshold level is approximately 3.0% per 0.3048 meter (one foot), the first preselected time period is approximately 2 minutes, the reduced threshold level is approximately 1.0% per 0.3048 meter (one foot), the second pre-selected time period is approximately 5-15 minutes, the first preselected CO rate is approximately 3 ppm/min, the third pre-selected time period is approximately 30 minutes, the second preselected CO rate is approximately 10 ppm/min and the fourth pre-selected time period is approximately 10 minutes.

3. The fire detector of claim 1 wherein the smoke detector is an ionization smoke detector.

4. The fire detector of claim 1 wherein the smoke detector is a photoelectric smoke detector.

5. The fire detector of claim 1 wherein the CO detector is a Non-Dispersive Infrared detector or an electrochemical cell detector.

6. A method for generating an alarm signal in response to a fire, comprising the steps of:

determining light obscuration by use of a smoke detector;

determining changes in carbon monoxide ("CO") concentration by use of a CO detector; and generating an alarm signal if any of the following criteria are met:

(1) the smoke detector detects a threshold level of light obscuration for greater than a first pre-selected time period;

(2) the smoke detector detects a reduced threshold level of light obscuration for greater than a second pre-selected time period;

(3) a rate of increase in CO concentration detected by the CO detector exceeds a first preselected CO rate for a third pre-selected time period and the smoke detector detects the reduced threshold level of light obscuration; or (4) the rate of increase in CO concentration detected by the CO detector exceeds a second preselected CO rate for a fourth pre-selected time period.

7. The method of claim 6 wherein the threshold level is approximately 3.0% per 0.3048 meter (one foot), the first preselected time period is approximately 2 minutes, the reduced threshold level is approximately 1.0% per 0.3048 meter (one foot), the second pre-selected time period is approximately 5-15 minutes, the first preselected CO rate is approximately 3 ppm/min, the third pre-selected time period is approximately 30 minutes, the second preselected CO rate is approximately 10 ppm/min and the fourth pre-selected time period is approximately 10 minutes.

8. The method of claim 6 wherein the smoke detector is an ionization smoke detector.

9. The method of claim 6 wherein the smoke detector is a photoelectric smoke detector.

10. The method of claim 6 wherein the CO detector is a Non-Dispersive Infrared detector or an electrochemical cell detector.

* * * * *